US005520470A

United States Patent [19]

Willett

[11] Patent Number: 5,520,470

[45] Date of Patent: May 28, 1996

[54] PORTABLE PRINTER FOR HANDHELD COMPUTER

[75] Inventor: Michael C. Willett, Akron, Ohio

[73] Assignee: Telxon Corporation, Akron, Ohio

[21] Appl. No.: 395,291

[22] Filed: Feb. 24, 1995

Related U.S. Application Data

[63] Continuation of Ser. No. 140,610, Oct. 21, 1993, abandoned.

[51] Int. Cl.[6] ..... B41J 3/36

[52] U.S. Cl. ..... 400/88; 400/693; 361/189

[58] Field of Search ..... 400/88, 691, 692, 400/693; 361/390, 391, 392, 939, 394, 189

[56] References Cited

U.S. PATENT DOCUMENTS

| | | | |
|---|---|---|---|
| 4,617,638 | 10/1986 | Krause et al. | 364/557 |
| 4,706,096 | 11/1987 | Sato | 400/73 |
| 4,980,814 | 12/1990 | Hosaka et al. | 364/131 |
| 5,090,830 | 2/1992 | Kroeger et al. | 400/719 |
| 5,146,490 | 9/1992 | Beckman | 379/113 |
| 5,209,583 | 5/1993 | Lewis et al. | 400/692 |

*Primary Examiner*—Ren Yan

*Attorney, Agent, or Firm*—Pretty, Schroeder, Brueggemann & Clark

[57] ABSTRACT

An improved portable printer apparatus adapted to interface with a handheld computer in either of two alternative ways, including via a connector locating in a receiving well into which the portable computer can be placed or, alternatively, via a radio link. This provides communication flexibility and enhanced reliability. In another feature, electrical power for the printer apparatus is automatically selected from between a power supply, an external battery, and an internal battery, according to a predetermined hierarchy.

9 Claims, 3 Drawing Sheets

FIG. 3
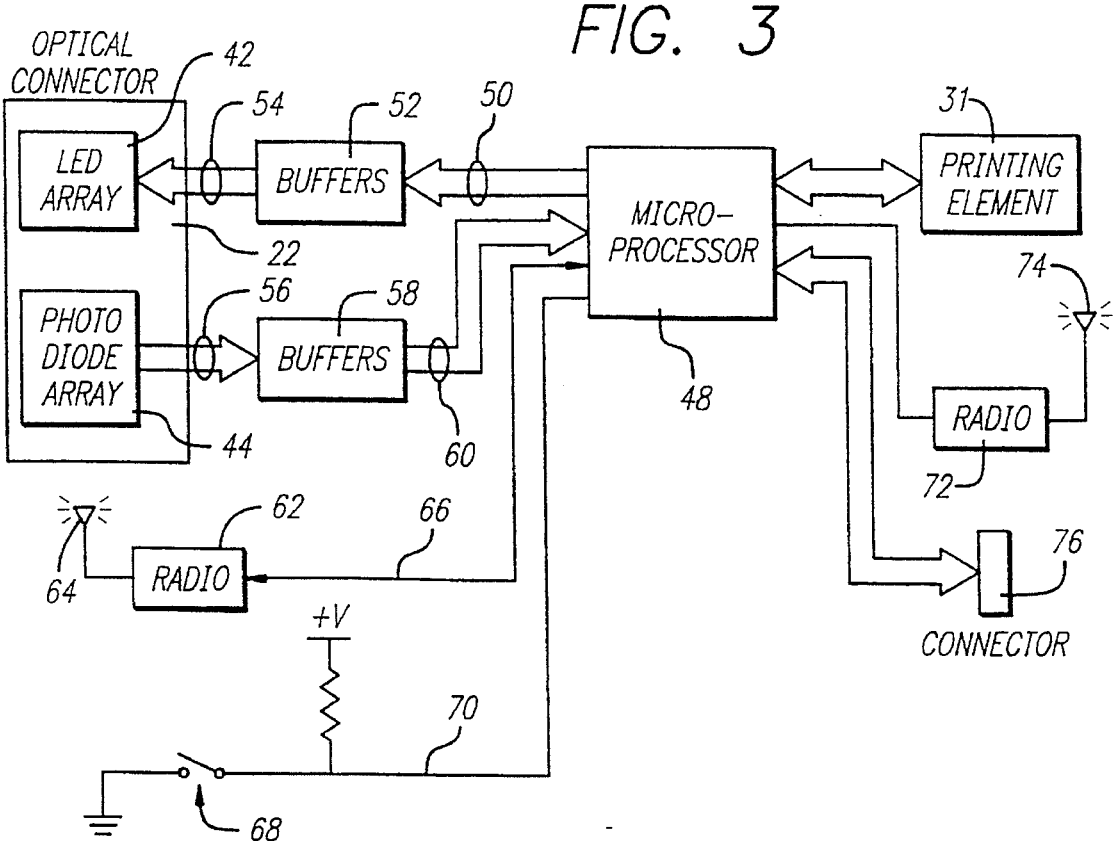
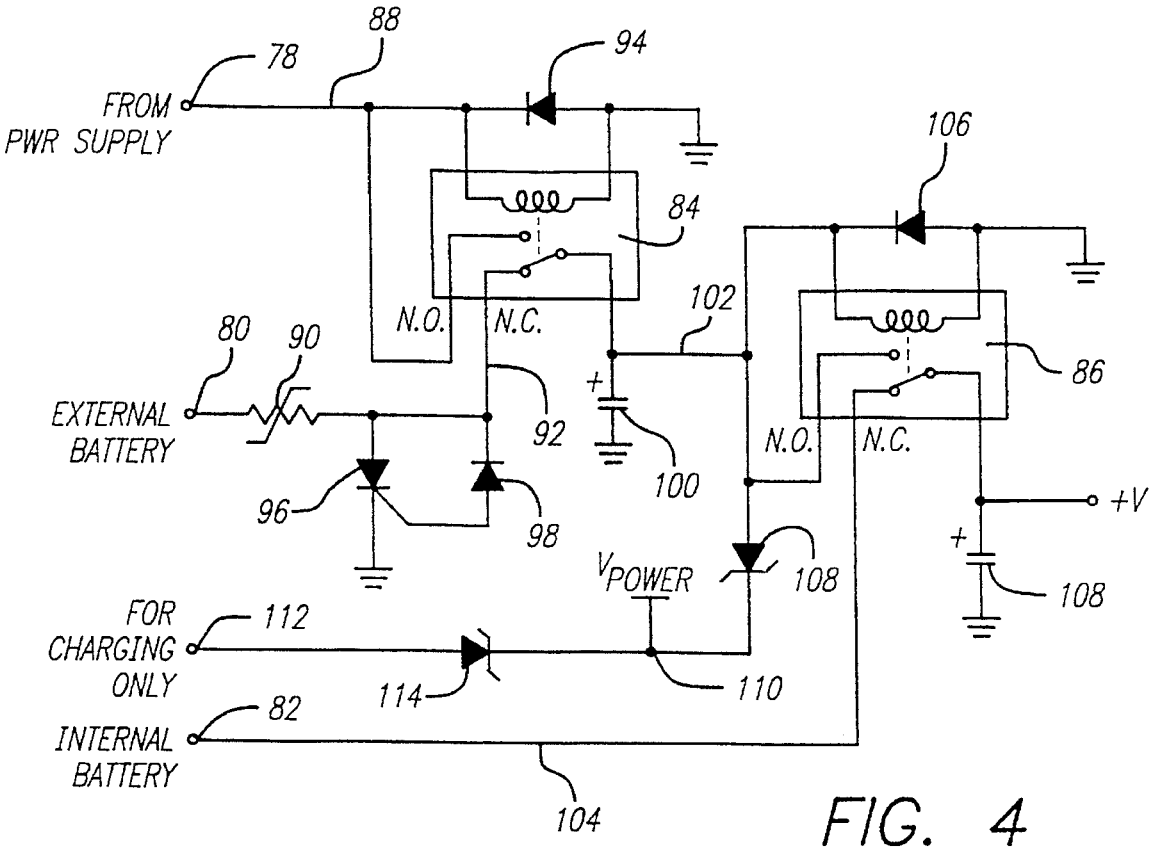
FIG. 4

PORTABLE PRINTER FOR HANDHELD COMPUTER

This application is a continuation of a prior pending application, application Ser. No. 08/140,610 filed on Oct. 21, 1993, now abandoned.

BACKGROUND OF THE INVENTION

1. Field of the Invention

This invention relates generally to printers that are adapted for use with handheld computers and, more particularly, to portable printers that are adapted to receive and carry portable, handheld teletransaction computers or data terminals.

2. Description of the Related Art

Portable printers adapted to receive and carry handheld computers or data terminals typically include a housing and associated carrying handle, a printer mechanism with a platen, a printing element and paper supply, a cradle and associated connector for receiving a handheld computer, and a power supply, an internal battery and a power cord for charging or ac operation. When the computer is received in the cradle, the printer connector automatically engages a connector of the computer. Data stored in the computer then can be printed in readable format onto the paper.

Portable printers of this kind sometimes are used to carry a handheld computer at a work site. While information is being entered into the computer, the printer is simultaneously providing a readable printout of the entered data. At other times, data is entered into the computer prior to its being received in the printer cradle, and a readable copy of the previously entered data is produced at a later time. For example, handheld computers and portable printers often are used by delivery personnel to record data relating to successive deliveries and pickups and to provide a printout or invoice for each delivery or pickup. The printer must be capable of being transported to work sites where it is needed and also capable of enduring harsh environmental conditions. Therefore, it is very important that the printer be small durable and lightweight. In addition, if the portable computer and printer ordinarily are to remain connected together, it is preferable that the printer provide some degree of external protection for the computer.

The mating engagement of the printer connector and the portable computer connector must be secure and positive, and must stand up to thousands of coupling cycles without deterioration. One of the two connectors typically includes many small, parallel metal connecting pins that are received by complementary conductive connecting bores in the other connector. Unfortunately, these connecting pins can be bent, or even broken, after many cycles of use. Efforts have been made in the past to reduce the possibility of so damaging the pins and thus reduce the frequency with which the printer must be serviced. Although such efforts have generally been considered successful, it is believed that a further reduction in the need for printer servicing is attainable.

Portable printers of this kind have been powered by multiple power sources, including an internal dc power supply receiving its power from an ac power cord, an external dc power source delivering power to the printer via a power connector, and an internal battery. Unfortunately, no convenient or automatic means for selecting from these various power sources is believed to have been available. This has led to time-consuming manual selections and to unnecessary drains on the internal battery.

It should therefore be appreciated that there is a need for an improved portable printer for use with a handheld computer or data terminal that has greater flexibility in its interfacing with the computer, while reducing the need for servicing its interface components, and it also should be appreciated that there is a need for an improved means for automatically selecting between the printer's various sources of power. The present invention satisfies these needs.

SUMMARY OF THE INVENTION

The present invention is embodied in a portable printer apparatus for use with a removable, handheld computer, to print information received from the handheld computer, with a reduced need for periodic servicing of the printer's elements that interface with the computer. The apparatus includes a housing having a receiving well sized to removably receive the handheld computer, with a connector being located in the well, for mating engagement with a corresponding connector carried by the computer. In addition, a first radio is located within the housing, for communicating via electromagnetic radiation with a corresponding radio carried by the computer. A data communications device located within the housing selectively communicates with the handheld computer via either the connector or the radio, and a printing element located within the housing prints out information received by the data communications device from the handheld computer. Thus, the printer apparatus interfaces with the handheld computer via either of two alternative means, i.e., the electrical connector and the radio. Both of these means have improved reliability over prior pin-type connectors. In addition, by allowing communication via either of these two alternative means, flexibility of use is provided by allowing communication to occur whether or not the computer is received within the receiving well.

In a more detailed feature of the invention, the connector includes a plurality of light-emitting diodes and a plurality of photosensors configured to communicate with corresponding photosensors and light-emitting diodes carried by the computer. These elements are appropriately aligned when the handheld computer is received within the receiving well. A manually-actuatable switch can be located on the housing of the printer apparatus, for conveniently selecting between a first communications mode that uses the connector and a second communications mode that uses the radio.

In another feature of the invention, the printer apparatus further comprises a second radio located within the housing, for communicating with a corresponding radio associated with a remote host computer. This enables the printer apparatus to function as a relay station between the handheld computer and the host computer.

In a separate, independent feature of the invention, the printer apparatus further comprises three separate power sources, including a dc power supply located within the housing, a dc power connector for receiving dc power from an external power source, and a battery located within the housing. In addition, selector means are provided for delivering power to the printing element, as well as other electrical components included in the printer apparatus, from a selected one of the several dc power sources. This selection is made automatically according to a predetermined hierarchy.

Other features and advantages of the present invention should become apparent from the following description of the preferred embodiment, taken in conjunction with the accompanying drawings, which illustrate, by way of example, the principles of the invention.

BRIEF DESCRIPTION OF THE DRAWINGS

FIG. 3 is a simplified block diagram of the data handling portion of the printer apparatus of FIG. 1.

FIG. 4 is a simplified schematic diagram of circuitry for automatically selecting between three separate power sources according to a predetermined hierarchy.

DESCRIPTION OF THE PREFERRED EMBODIMENT

Figure 1:
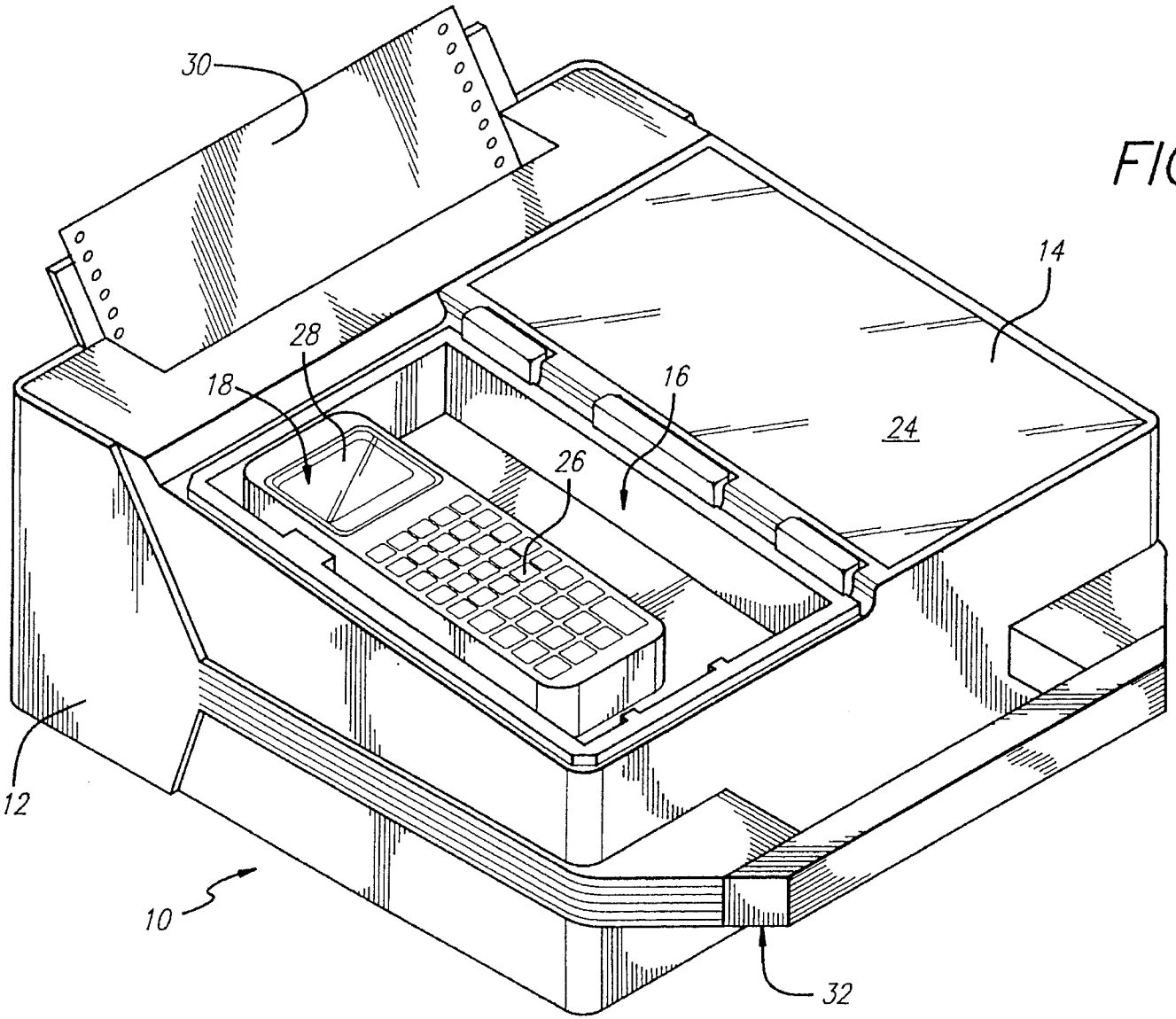
FIG. 1 is a top, front perspective view of a portable printer embodying the present invention, having a receiving well in its top side for receiving a handheld computer or teletransaction terminal.
Figure 2:
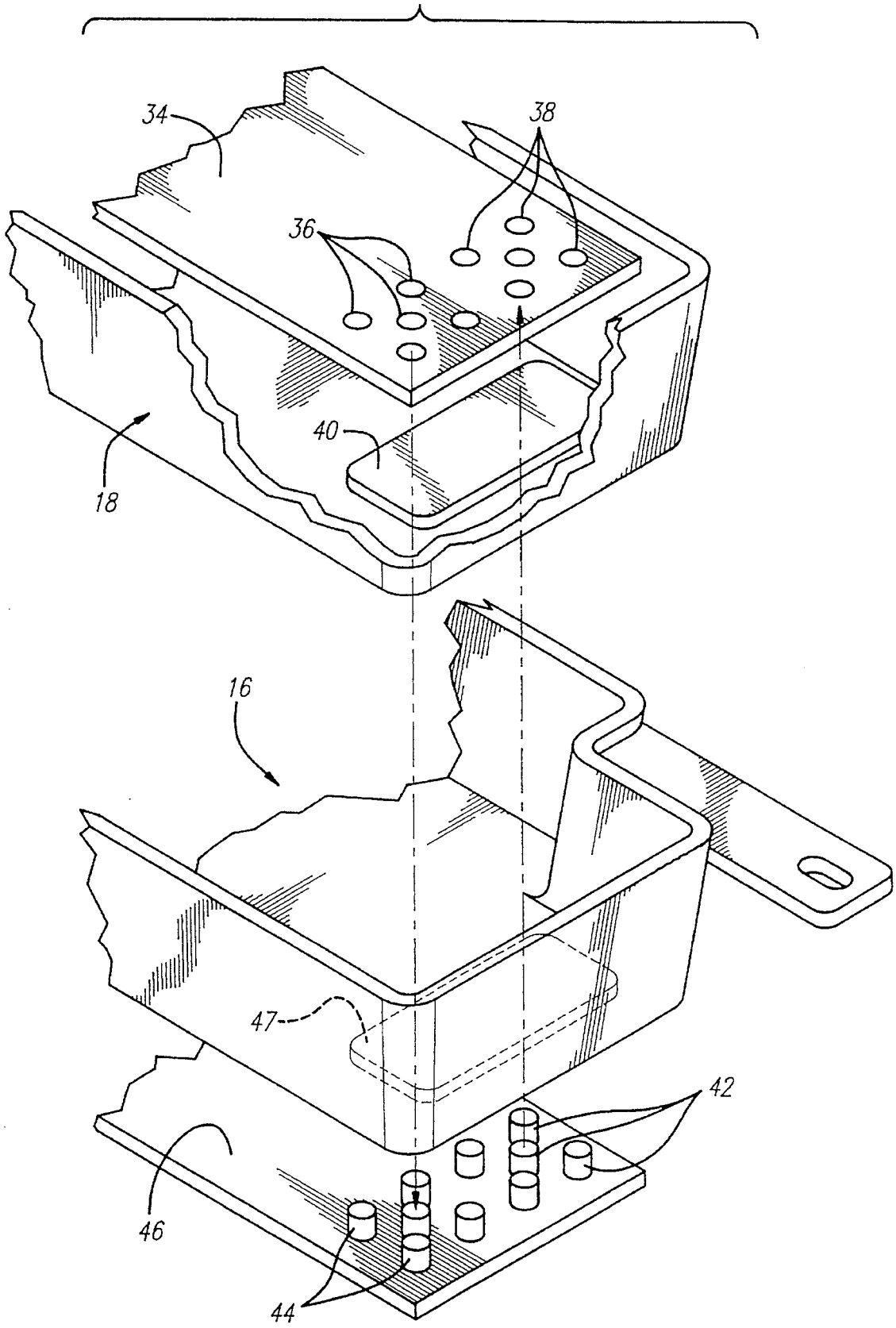
FIG. 2 is an exploded perspective view of a portion of the handheld computer and portable printer of FIG. 1, showing an optical connector of each for communicating data.

With reference now to the drawings, and particularly to FIGS. 1 and 2, a printer 10 includes a housing 12 with a hinged cover 14 that can be pivoted open to expose a receiving well 16 for receiving a handheld computer or teletransaction terminal 18. When the handheld computer is to be connected to the printer, it is placed in the receiving well where an optical connector 20 on the computer's underside automatically aligns with a complementary optical connector 22 in the bottom of the receiving well. Data transferred from the handheld computer to the printer via the optical connectors can be transmitted immediately via a radio link to a host computer (not shown) or can be stored for subsequent transfer by radio link or otherwise to the host computer. Data likewise can be transmitted via radio link or otherwise from the host computer to the printer.

The receiving well cover 14 takes up substantially the left half of the printer's top surface and it is hinged such that, when the cover is open, it can be laid flat and its underside 24 can be used as a writing surface. A keyboard 26 of the handheld computer 18 can then be used to enter data for display on a display 28 of the computer and for printout on paper 30 using a printing element 31 contained within the printer housing 12. The orientation of the computer relative to the housing and relative to the paper make the printer especially suited for use in a vehicle, such as a delivery truck, because the printer can be laid on a seat while allowing the vehicle driver easily to operate a computer carried in the printer's receiving well 16.

When the receiving well cover 14 is closed, the panel on the opposite side of the printer's top surface can be raised to expose a storage area (not illustrated), in which can be stored items such as an electrical power cord for charging or ac operation. The receiving well and storage area can be removed and reversed in location. This is especially useful to accommodate left-hand drive and right-hand drive vehicles, so that the receiving well can be placed on the correct half of the printer. A carrying handle 32 allows the printer to be easily lifted and moved about.

The receiving well cover 14 and the panel above the storage area both include a mechanical or magnetic latch (not shown) for securing them in their closed positions. In addition, a locking mechanism (not shown) secures the handheld computer 18 in place within the receiving well 16. This is especially important when the printer 10 and computer are being transported about. One suitable locking mechanism is disclosed in U.S. Pat. No. 5,209,583, entitled "COMPACT PRINTER FOR PORTABLE COMPUTER."

FIG. 2 is an exploded perspective view of the complementary optical connectors 20 and 22 of the respective handheld computer 18 and printer 10. A printed circuit (PC) board 34 located within the computer carries five light-emitting diodes (LEDs) 36 arranged in an X pattern on the PC board's underside, along with five phototransistors or photodiodes 38 similarly arranged in an X pattern adjacent to the LEDs. A red-tinted plastic lens 40 overlays the LEDs and photodiodes on the underside of the computer's casing, for protection and concealment.

Similarly, five LEDs 42 and five phototransistors or photodiodes 44 are carried on a PC board 46 located within the printer 10, immediately beneath the receiving well 16. These LEDs and photodiodes are arranged in X patterns corresponding to the patterns of the LEDs 36 and photodiodes 38 of the computer 18 and they are overlayed by a red-tinted plastic lens 47. The LEDs and photodiodes are strategically positioned such that, when the computer is properly received in the receiving well, the computer LEDs 36 are precisely aligned with the printer photodiodes 44, and the printer LEDs 42 are precisely aligned with the computer photodiodes 38.

A simplified block diagram of the printer's communications circuitry is provided in FIG. 3. Communications are controlled by a microprocessor 48. For communications from the printer 10 to the handheld computer 18, the microprocessor controls the printer LEDs 42 by outputting drive signals on lines 50 to a set of buffers 52 and, in turn, on lines 54 to the LEDs. This pulses the LEDs ON and OFF, which is detected by the corresponding photodiodes 38 in the handheld computer.

For communications in the opposite direction, from the handheld computer 18 to the printer 10, the printer photodiodes 44 detect modulated light generated by the computer LEDs 36 and generate corresponding receive signals. These signals are transmitted on lines 56 to a set of buffers 58 and, in turn, on lines 60 to the microprocessor 48.

Signals thereby are communicated from one device to the other without the need for any electrical connector pins, thereby avoiding the possibility of bending, wearing or even breaking such pins. The printer 10 thereby has improved reliability and it need be serviced substantially less frequently.

Data frequently is entered into the handheld computer 18 for storage when the computer is located remote from the printer 10. After a period of time accumulating such data, it is frequently desired to transfer the data to the printer, to obtain a data printout on the paper 30. This is conveniently accomplished by simply placing the computer in the receiving well 16 of the printer, whereupon the stored data can be transferred to the printer via the optical connectors 20 and 22, as described above.

Sometimes, however, it is desired to transfer the data from the handheld computer 18 to the printer 10 before the computer has been returned to the site of the printer. For this reason, as shown in FIG. 3, the printer includes a radio 62 and an associated antenna 64, for communicating with the computer over the air. The radio is controlled by the microprocessor 48 via line 66. Either a narrow band or spread spectrum modulation scheme may be used. The radio is located within the printer housing 12, while the antenna may be located within the housing or, alternatively, may be attached to the housing's exterior.

A selection between use of the optical connectors 20 and 22 or the radio 62 for communication between the handheld computer 18 and the printer 10 can conveniently be accomplished using a manual switch 68 (FIG. 3) located on the printer and connected to the microprocessor 48 via line 70. This switch conveniently can take the form of a limit switch located in the receiving well 16 and positioned such that placement of the handheld computer within the well closes the switch and causes the printer to utilize the optical connectors for data communications. Otherwise, the data communication is accomplished using the radio.

The printer 10 further includes a second radio 72 and associated antenna 74, for transmitting and receiving data to and from a remote host computer (not shown). This enables data accumulated by the handheld computer 18 to be downloaded to the host computer at periodic intervals. It also allows data instructions to be transmitted to the printer and handheld computer by the host computer. Either narrowband or spread-spectrum modulation can be used. An electrical connector 76 alternatively can deliver such data to and from a cable connected to such host computer. Serial data communication at 9.6 kilobits per second is considered suitable.

Being portable, the printer 10 occasionally will be used in environments having a temperature below about 10° Centigrade. At such temperatures, the printout provided by the printing element 31 might not be sufficiently dark to be fully readable. The printer therefore can selectively change to a cold-temperature mode of operation in which the printing element double-strikes each character. Although the printing speed is reduced in this mode, the printout is more readable.

The printer 10 operates under dc power received from any of several sources. These sources include 1) an internal power supply receiving ac power via a conventional power cord, 2) an external battery, and 3) an internal battery. Dc power is preferentially selected from these sources in the order listed.

Electrical circuitry for preferentially selecting from the various dc power sources is depicted in FIG. 4. The circuitry receives dc power from the power supply at a terminal 78, from the external battery at a terminal 80, and from the internal battery at a terminal 82. Selection from these alternative sources is accomplished using first and second relays 84 and 86, respectfully. Each relay includes a coil and associated switch, with a normally-open input (NO) terminal, a normally-closed (NC) input terminal, and an output terminal.

The dc power supply source is connected via the terminal 78 and line 88 to the normally-open input terminal of the first relay 84, and the external battery is connected via the terminal 80, a fuse 90, and line 92 to the normally-closed input terminal of the same relay. Dc power from the power supply also is applied via line 88 through the coil portion of the relay 84 to ground.

If dc power from the power supply is present at terminal 78, a field will be developed in the coil of the relay 84 so as to move the relay switch to connect the normally-open input terminal to the output terminal and to disconnect the normally-closed input terminal from the output terminal. This couples such dc power from the power supply to the relay's output terminal. On the other hand, if dc power from the power supply is not present, the relay will remain with its normally-closed terminal connected to the output terminal. Dc power, if any, from the external battery therefore will be present at the relay's output terminal. A diode 94 shunts the coil portion of the relay 84, to discharge the field in the coil when dc power from the power supply is removed. In addition, diodes 96 and 98 protect the circuitry from excessive voltages applied to the external battery terminal 80. A capacitor 100 smoothes and stabilizes the voltage present at the output terminal of the relay 84.

In a similar fashion, the voltage present at the output terminal of the first relay 84 is applied via line 102 to the normally-open input terminal of the second relay 86, and the internal battery terminal 88 is connected via line 104 to the normally-closed input terminal of that same relay. The voltage supplied on line 102 also is applied to the coil portion of the relay 86. Thus, if an external batter is in fact connected at the terminal 80, or if the dc power supply is supplying power to the circuitry via the terminal 78, or both, then the coil of the relay 86 will be energized, to move the relay switch so as to connect the normally-open input terminal and open the normally closed contact. This causes the voltage present on line 102 to be coupled through the relay 86 to the output terminal +V. On the other hand, if no voltage is present on line 102, meaning that power is not available either from an external battery at the terminal 80 or from the power supply, at the terminal 78, then the switch portion of the relay 86 remains in its normal position, and the normally-closed input terminal is connected to the output terminal. The output terminal therefore carries the voltage from the internal battery applied at the terminal 82. In similar fashion to the first relay 84, a diode 106 shunts the coil portion of the second relay, and a capacitor 108 smoothes and stabilizes the voltage +V present at the output terminal.

It thus will be appreciated that the power selection circuitry of FIG. 4 defaults to an arrangement in which internal battery power supplies the output voltage +V. However, if dc power is received either from the dc power supply at terminal 78 or from an external battery at terminal 80, such power is substituted for the internal battery. In addition, as between external battery power and power from the power supply, the circuitry automatically selects the latter if it is available. By this arrangement, an unnecessary draining of the internal battery is minimized. Moreover, an unnecessary drain on the external battery, likewise, is minimized if power is available from the power supply, which is powered by an external ac source.

Charging of the printer's internal battery, which is typically a nickel-cadmium battery, may be accomplished using dc power supplied by the power supply via terminal 78 or the external battery via terminal 80. Charging current can be supplied from the output terminal of the first relay 84 through a zener diode 108 to a terminal 110. Alternatively, charging current may be supplied to the terminal via a charging terminal 112 and zener diode 114.

It should be appreciated from the foregoing description that the present invention provides an improved printer apparatus having multiple features for enhancing its performance. In particular, the apparatus interfaces with a handheld computer in either of two alternative ways, including via a connector locating in a receiving well into which the portable computer can be placed or, alternatively, via a radio link. In another feature, electrical power for the printer apparatus is automatically selected from between a power supply, an external battery, and an internal battery, according to a predetermined hierarchy.

Although the present invention has been described in detail with reference only to the presently preferred embodiment, those of ordinary skill in the art will appreciate that various modifications can be made without departing from the invention. Accordingly, the invention is defined only by the following claims.

I claim:

1. A portable printer apparatus for use with a removable, handheld computer, to print information received from the handheld computer, the apparatus comprising:

a housing having a receiving wall sized to removably receive a handheld computer;

a connector located in the well of the housing, for mating engagement with a corresponding connector carried by the handheld computer when the handheld computer is received in the receiving well of the housing;

a first radio located within the housing for communicating with a corresponding radio carried by the handheld computer;

a data communications device located within the housing, for selectively communicating with the handheld computer via one of two direct communications paths that are respectively established using the connector and the radio;

a printing element located within the housing, for printing information received by the data communications device from the handheld computer via either one of the two communications paths;

a dc power supply located within the housing; and a dc power terminal for receiving dc power from an external power source;

a battery located within the housing; and a selection circuit that automatically selects a power source from one of the dc power supply, the power terminal, and the battery and that uses the selected power source as the principal power supply for the printing element;

wherein the selection circuit includes means for defining a predetermined hierarchy among at least the dc power supply, the power terminal and the battery;

and wherein the selection circuit is responsive to said means to automatically select the power source according to the predetermined hierarchy.

2. A portable printer apparatus as defined in claim 1, wherein the connector includes a plurality of light-emitting diodes and a plurality of photosensors configured to communicate with a corresponding plurality of photosensors and light-emitting diodes carried by the handheld computer.

3. A portable printer apparatus as defined in claim 1, and further comprising a second radio located within the housing, for communicating with a corresponding radio associated with a remote host computer.

4. A portable printer apparatus as defined in claim 1, wherein the data communications device includes a manually-actuatable switch for selecting between a first communications mode that uses the connector and a second communications mode that uses the first radio.

5. A portable printer apparatus for use with a removable, handheld computer, to print information received from the handheld computer, the apparatus comprising:

a housing having a receiving well sized to removably receive a handheld computer;

a connector located in the well of the housing, for mating engagement with a corresponding connector carried by the handheld computer, for communicating data when the handheld computer is received in the receiving well of the housing;

a data communications device located within the housing, for communicating with the handheld computer via the connector located in the well of the housing;

a printing element located within the housing, for printing information received by the data communications device from the handheld computer;

a dc power supply located within the housing, the dc power supply converting power supplied by an ac power source to dc power;

a dc power terminal for receiving dc power from an external power source;

a battery located within the housing; and a selection circuit that automatically selects a power source from one of the dc power supply, the power terminal, and the battery and that uses the selected power source as the principal power supply for the printing element;

wherein the selection circuit includes means for defining a predetermined hierarchy among at least the dc power supply, the power terminal and the battery, and wherein the selection circuit is responsive to said means to automatically select the power source according to the predetermined hierarchy.

6. A portable printer apparatus as defined in claim 5, wherein:

the apparatus further includes a first radio located within the housing, for communicating with a corresponding radio carried by the handheld computer; and the data communications device is configured to selectively communicate with the handheld computer via one of two direct communications paths that are respectively established using the connector and the first radio.

7. A portable printer apparatus as defined in claim 6, wherein the connector includes a plurality of light-emitting diodes and a plurality of photosensors configured to communicate with a corresponding plurality of photosensors and light-emitting diodes carried by the handheld computer.

8. A portable printer apparatus as defined in claim 6, and further comprising a second radio located within the housing, for communicating with a corresponding radio associated with a remote host computer.

9. A portable printer apparatus as defined in claim 6, wherein the data communications device includes a manually-actuatable switch for selecting between a first communications mode that uses the connector and a second communications mode that uses the first radio.

* * * * *